US009897280B2

(12) United States Patent
Andrisin, III et al.

(10) Patent No.: US 9,897,280 B2
(45) Date of Patent: Feb. 20, 2018

(54) PATH LIGHT AND UNITARY GASKET-REFLECTOR

(71) Applicant: The L.D. Kichler Co., Cleveland, OH (US)

(72) Inventors: John J Andrisin, III, Brunswick, OH (US); Christopher Robert Schmauder, Fairview Park, OH (US)

(73) Assignee: The L.D. Kichler Co., Cleveland, OH (US)

( * ) Notice: Subject to any disclaimer, the term of this patent is extended or adjusted under 35 U.S.C. 154(b) by 0 days.

(21) Appl. No.: 15/450,582

(22) Filed: Mar. 6, 2017

(65) Prior Publication Data

US 2017/0175977 A1 Jun. 22, 2017

Related U.S. Application Data

(63) Continuation of application No. 14/606,319, filed on Jan. 27, 2015, now Pat. No. 9,625,122.

(60) Provisional application No. 61/932,313, filed on Jan. 28, 2014.

(51) Int. Cl.

| | |
|---|---|
| ***F21V 9/16*** | (2006.01) |
| ***F21V 7/00*** | (2006.01) |
| ***F21V 31/00*** | (2006.01) |
| ***F21V 7/04*** | (2006.01) |
| ***F21V 7/22*** | (2018.01) |
| ***F21V 3/00*** | (2015.01) |
| ***F21V 3/04*** | (2018.01) |
| ***F21V 13/02*** | (2006.01) |
| ***F21V 17/10*** | (2006.01) |
| *F21Y 115/10* | (2016.01) |
| *F21Y 105/18* | (2016.01) |

(52) U.S. Cl.

CPC ..... *F21V 7/0058* (2013.01); *F21V 3/00* (2013.01); *F21V 3/0463* (2013.01); *F21V 7/04* (2013.01); *F21V 7/22* (2013.01); *F21V 13/02* (2013.01); *F21V 17/104* (2013.01); *F21V 31/005* (2013.01); *F21Y 2105/18* (2016.08); *F21Y 2115/10* (2016.08)

(58) Field of Classification Search

CPC ..... F21V 7/0058

See application file for complete search history.

(56) References Cited

U.S. PATENT DOCUMENTS

| | | | | |
|---|---|---|---|---|
| 6,260,981 | B1 * | 7/2001 | Fiene | E04B 9/32 362/147 |
| 6,558,033 | B1 | 5/2003 | Ruuttu et al. | |
| 2007/0217206 | A1 | 9/2007 | Bayat et al. | |
| 2007/0253200 | A1 | 11/2007 | Russello et al. | |
| 2010/0020541 | A1 | 1/2010 | Incorvia et al. | |
| 2011/0170294 | A1 | 7/2011 | Mier-Langner et al. | |
| 2011/0222307 | A1 | 9/2011 | Kong | |
| 2011/0235323 | A1 | 9/2011 | Allegri | |
| 2013/0201690 | A1 | 8/2013 | Vissenberg et al. | |
| 2013/0235589 | A1 | 9/2013 | Ohno et al. | |
| 2013/0242566 | A1 | 9/2013 | Kim | |
| 2016/0010841 | A1 | 1/2016 | Qin | |

* cited by examiner

*Primary Examiner* — Evan Dzierzynski

(74) *Attorney, Agent, or Firm* — Calfee, Halter & Griswold, LLP

(57) ABSTRACT

The present application discloses a unitary gasket-reflector for use in light sources having at least one reflector and at least one gasket to seal the inside of the light sources against the elements.

12 Claims, 16 Drawing Sheets

PATH LIGHT AND UNITARY GASKET-REFLECTOR

CROSS REFERENCE TO RELATED APPLICATIONS

This application is a continuation of U.S. application Ser. No. 14/606,319, filed Jan. 27, 2015 which claims priority to and the benefit of U.S. Provisional Patent Application Ser. No. 61/932,313, filed Jan. 28, 2014, and also entitled "PATH LIGHT AND UNITARY GASKET-REFLECTOR," the entire disclosures of both of which are incorporated herein by reference.

BACKGROUND

The present disclosure generally relates to the field of light sources and, more specifically, to a light source having at least one reflector and at least one gasket to seal the inside of the light source against the elements.

SUMMARY

The present application discloses a unitary gasket-reflector for use in light sources having at least one reflector and at least one gasket to seal the inside of the light sources against the elements.

DETAILED DESCRIPTION

Figure 1:
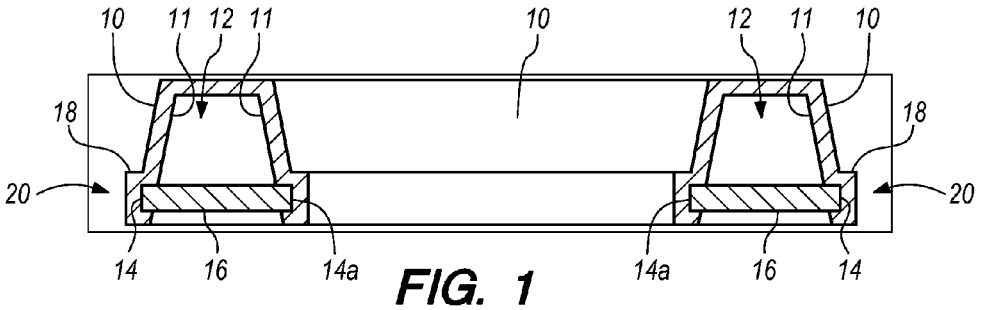
FIGS. 1-3 are side sectional, side/top sectional, and side/bottom sectional views of an exemplary unitary gasket-reflector holding an exemplary light modifier.
Figure 2:
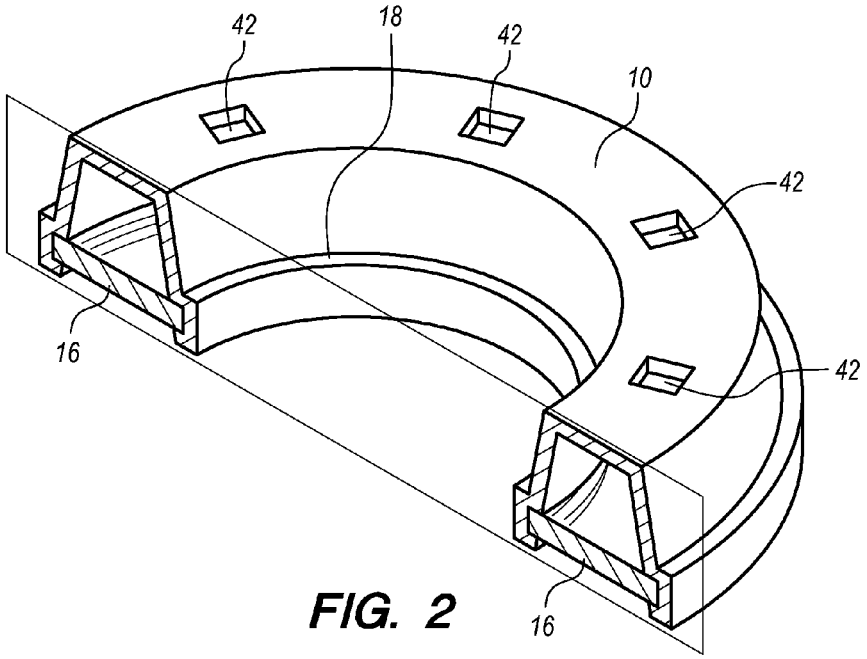
Figure 1A:
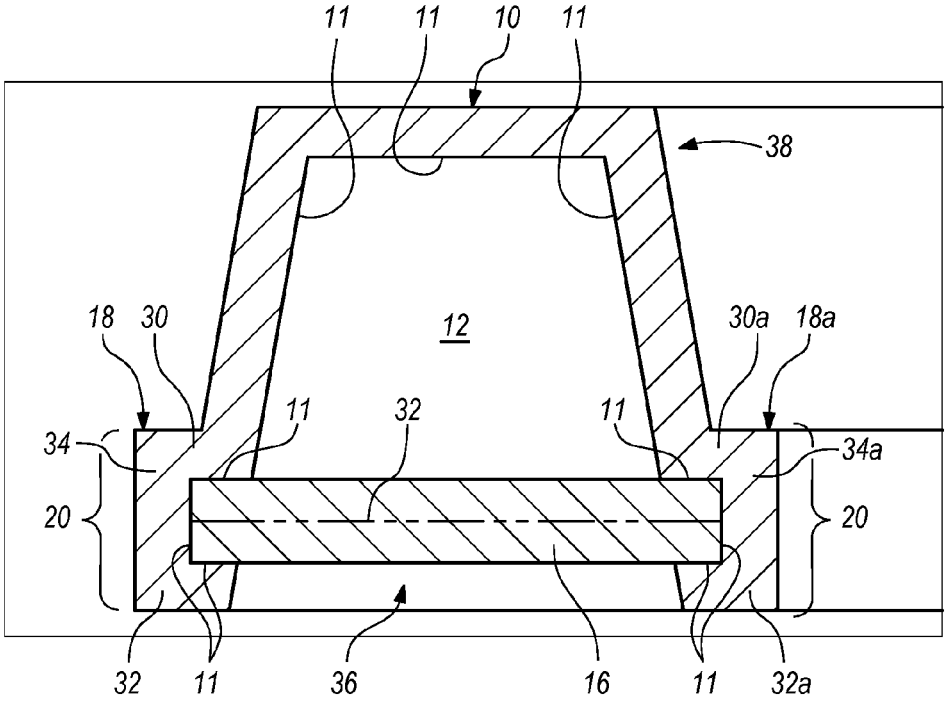
FIG. 1A is an enlargement of the left portion of FIG. 1.
Figure 1B:
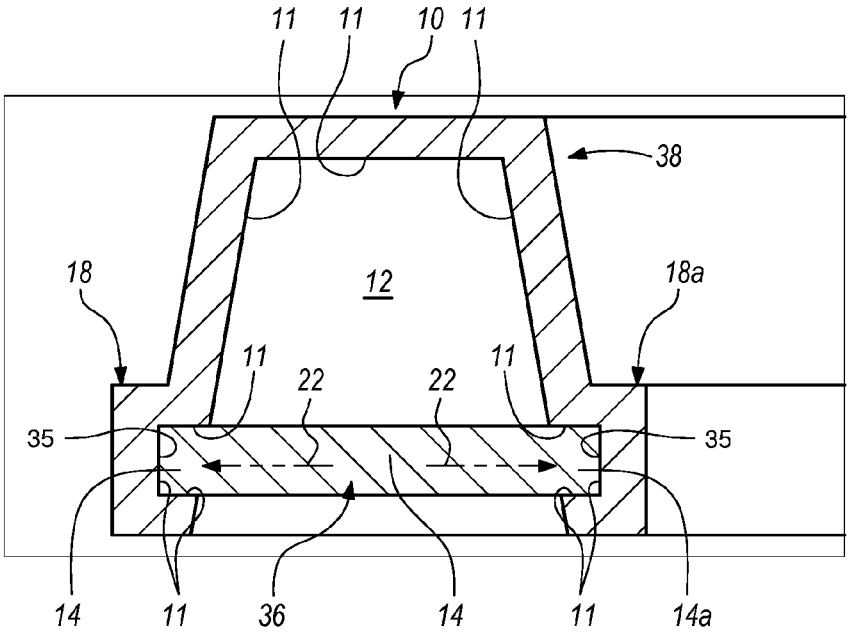
FIG. 1B is an enlargement of the left portion of FIG. 1 without the exemplary light modifier.
Figure 3:
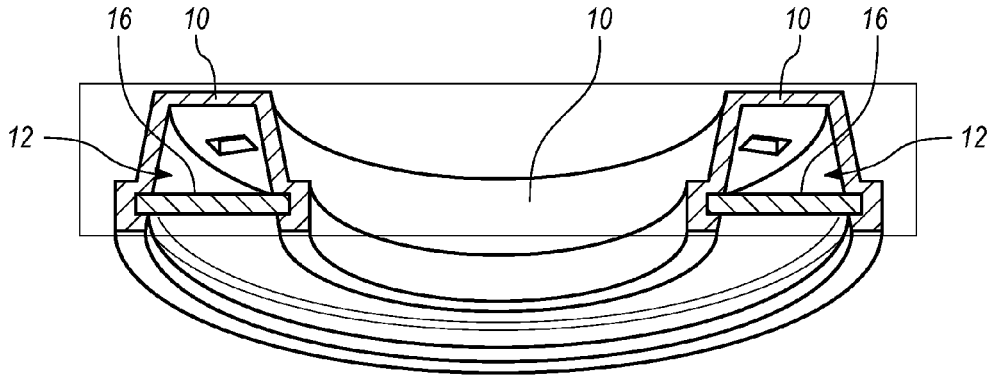
Figure 4:
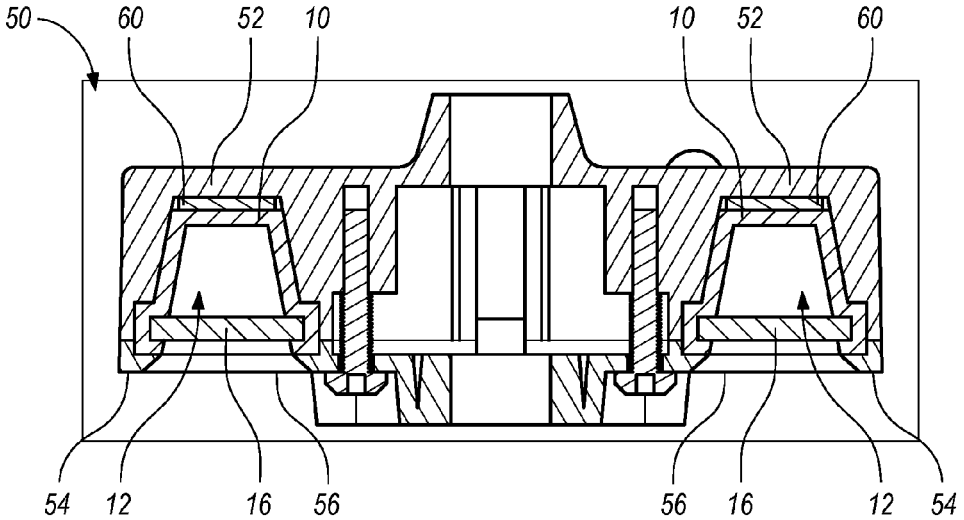
FIGS. 4-5 are side sectional and side/top sectional views of an exemplary light module including the exemplary unitary gasket-reflector of FIGS. 1-3.
Figure 5:
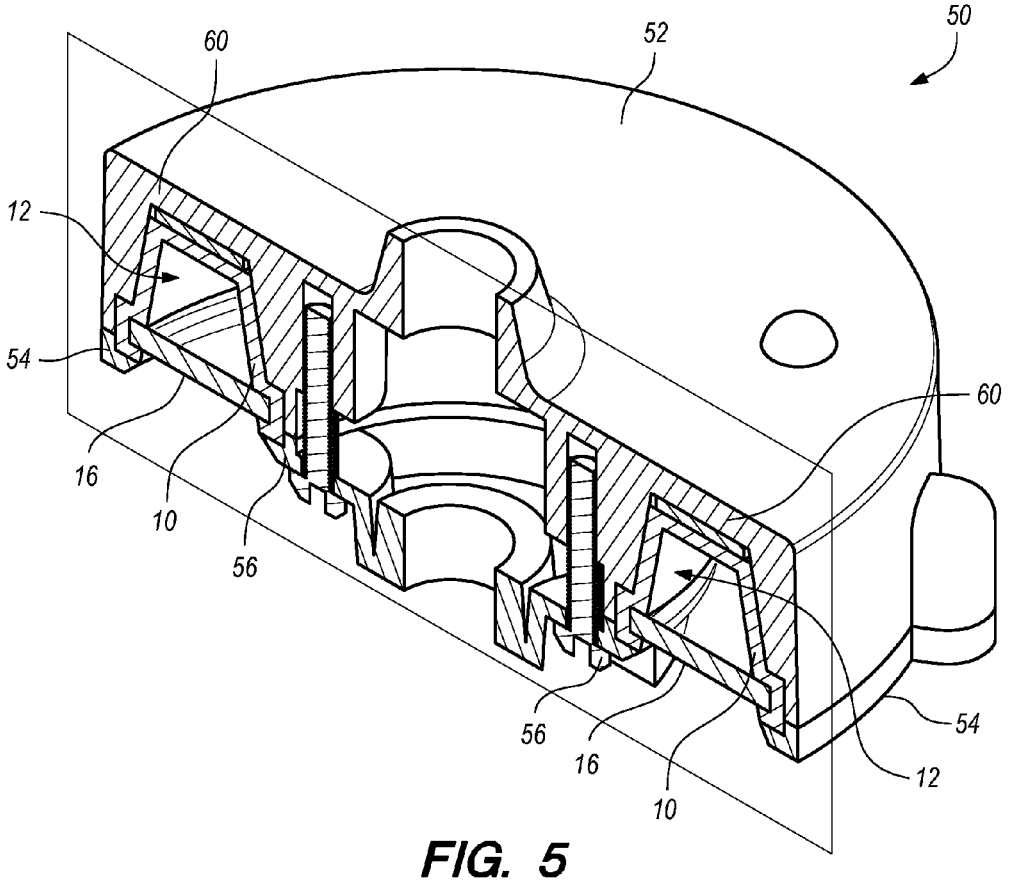
Figure 6:
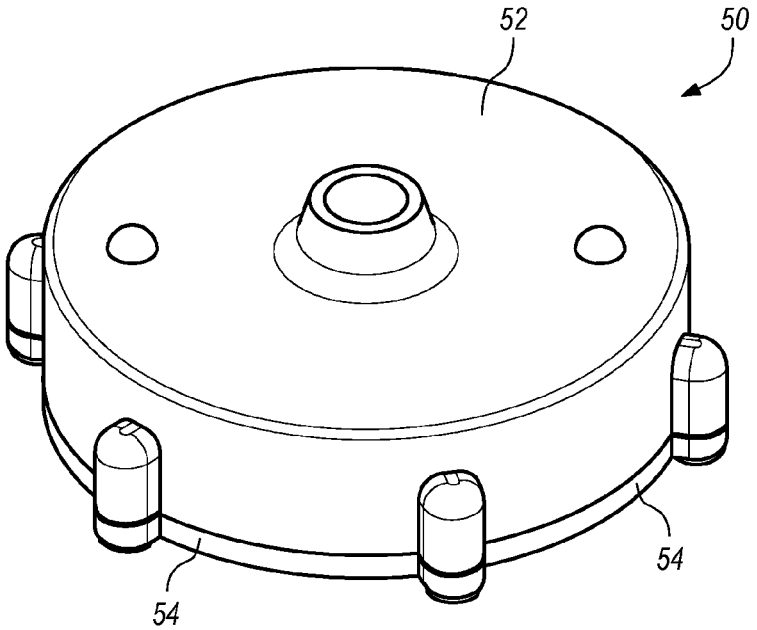
FIGS. 6-11 show various views of the exemplary light module of FIGS. 4-5.
Figure 7:
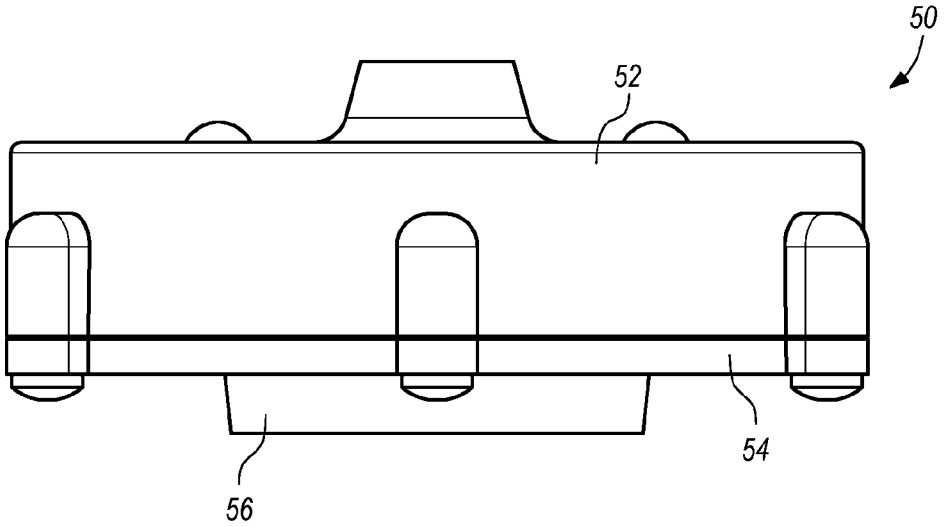
Figure 8:
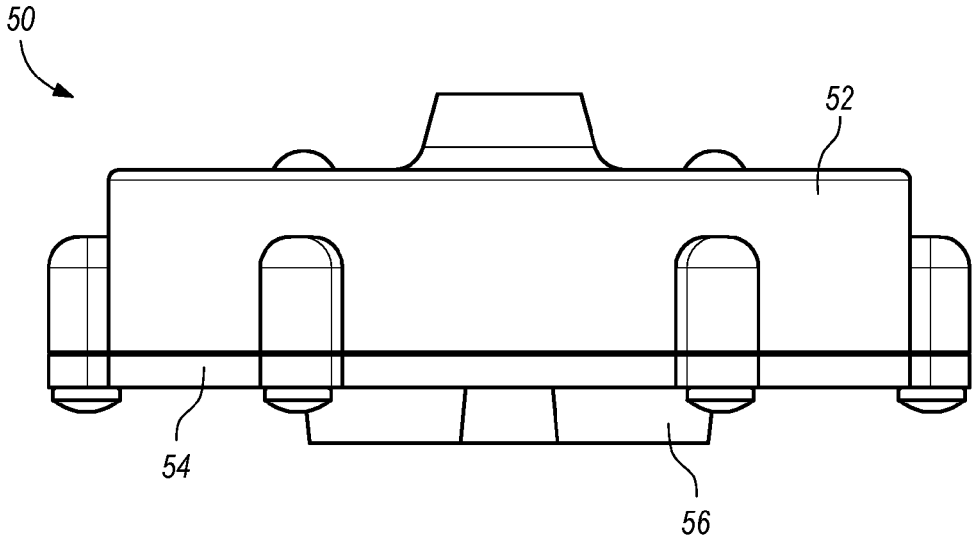
Figure 9:
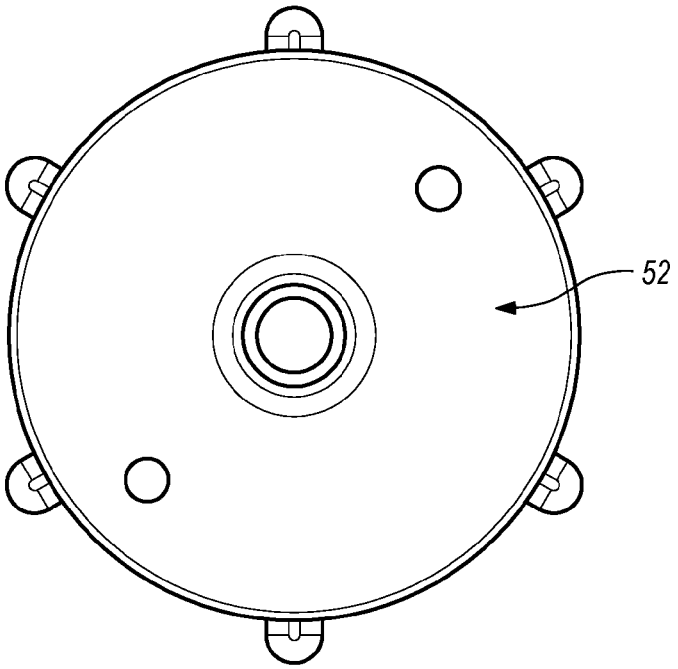
Figure 10:
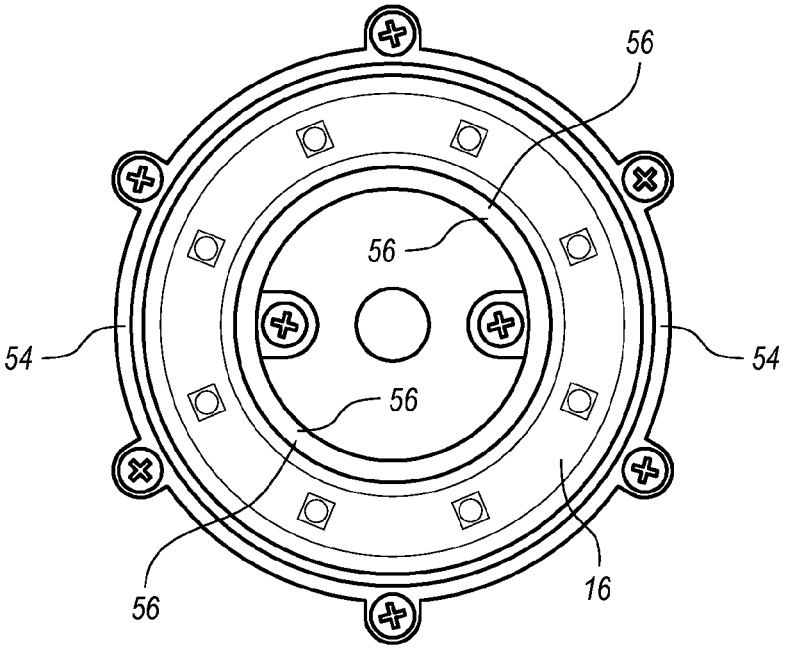
Figure 11:
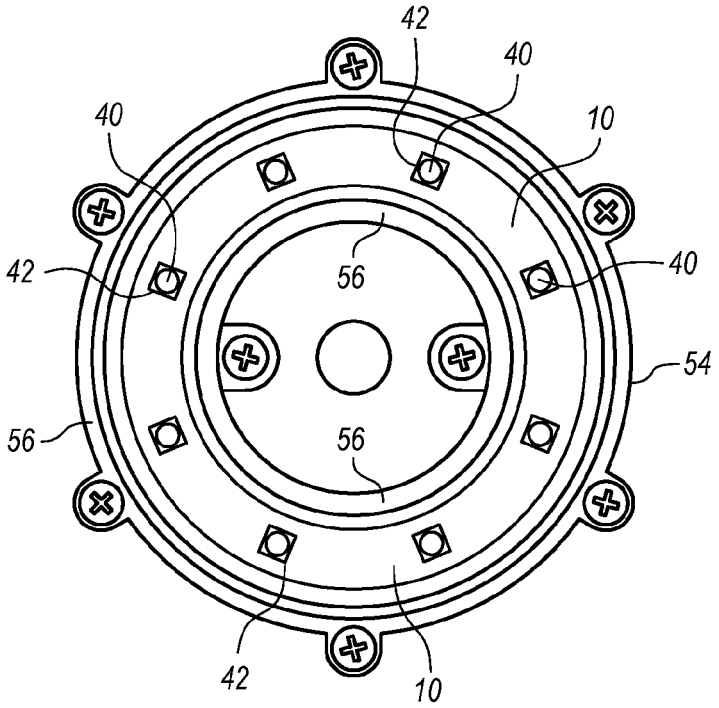
Figure 12:
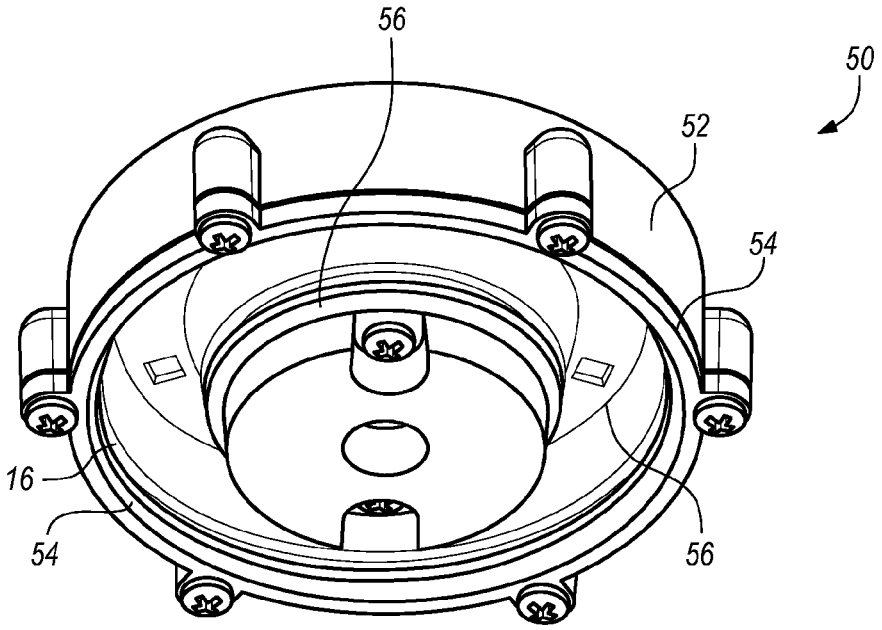
FIG. 12 shows a bottom view (like FIG. 10) of the exemplary light module of FIGS. 6-11 with the exemplary light modifier removed to more clearly show light sources inside the exemplary light module.
Figure 13:
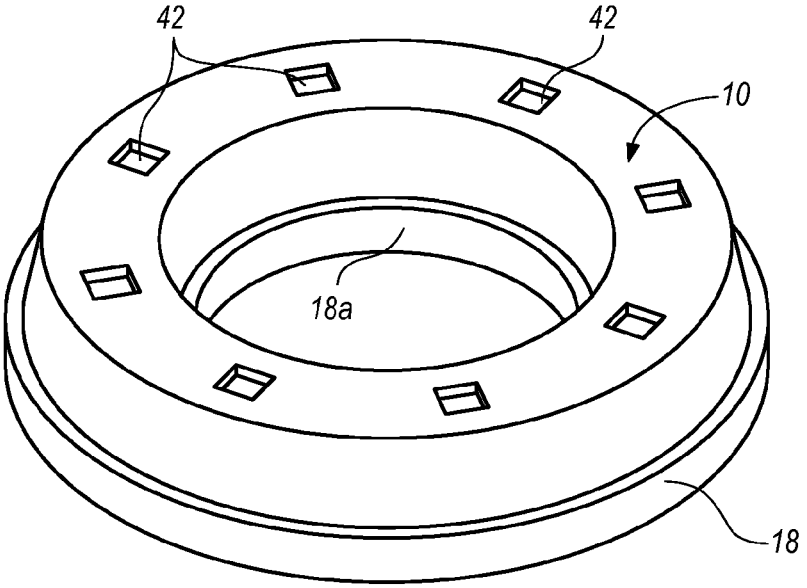
FIGS. 13-19 show various views of an exemplary unitary gasket-reflector.
Figure 14:
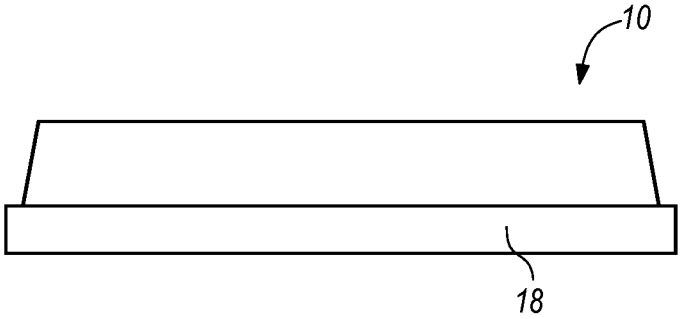
Figure 15:
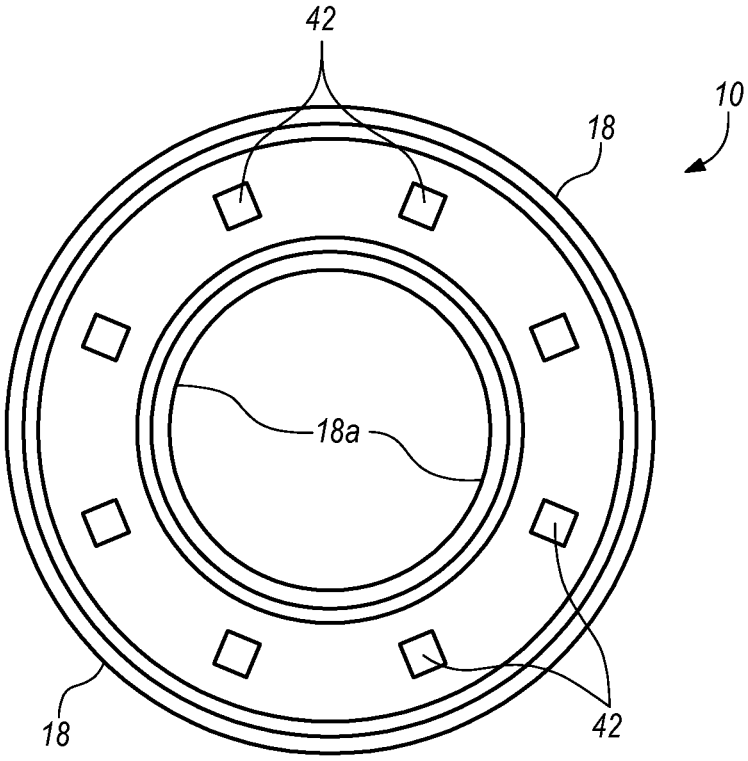
Figure 16:
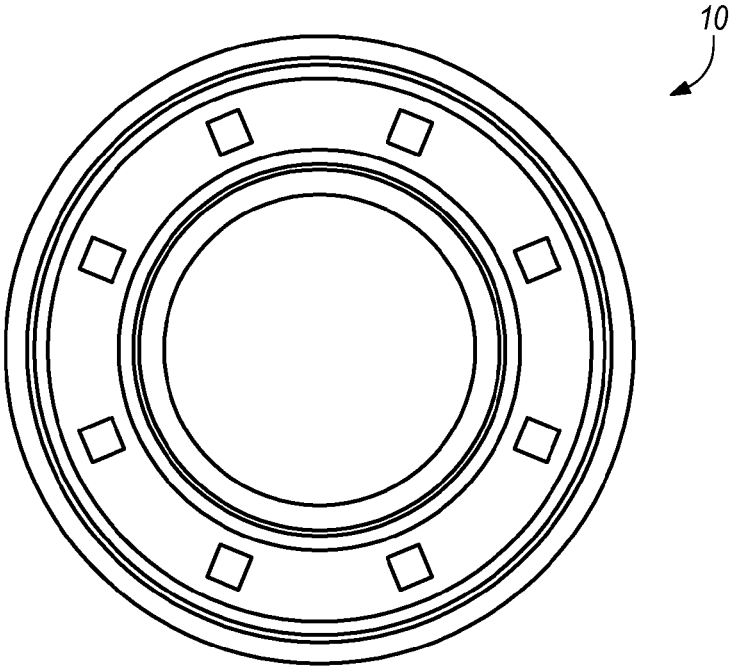
Figure 17:
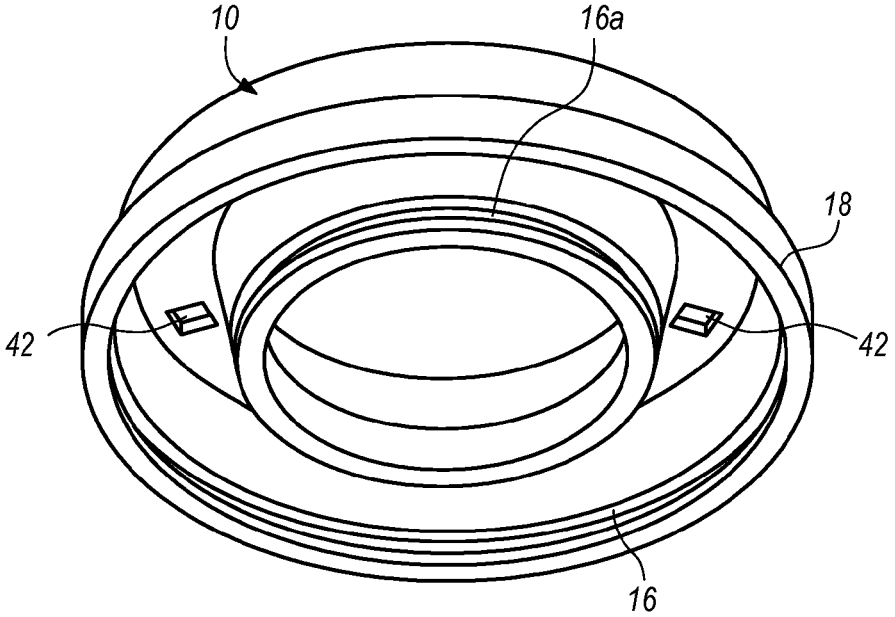
Figure 18:
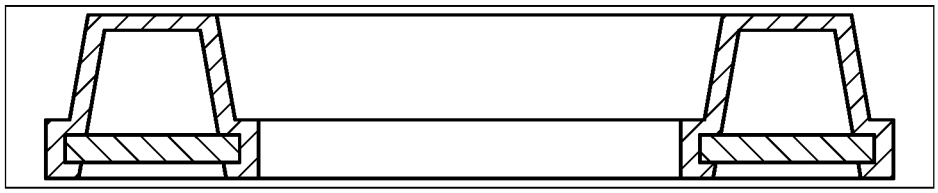
Figure 19:
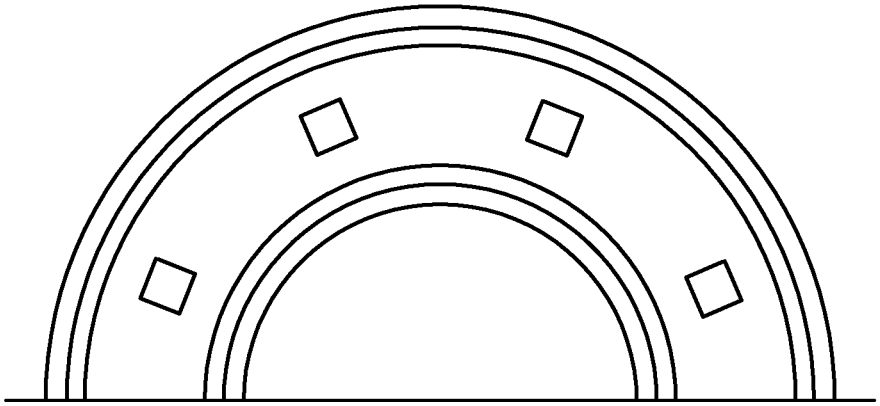
Figure 20:
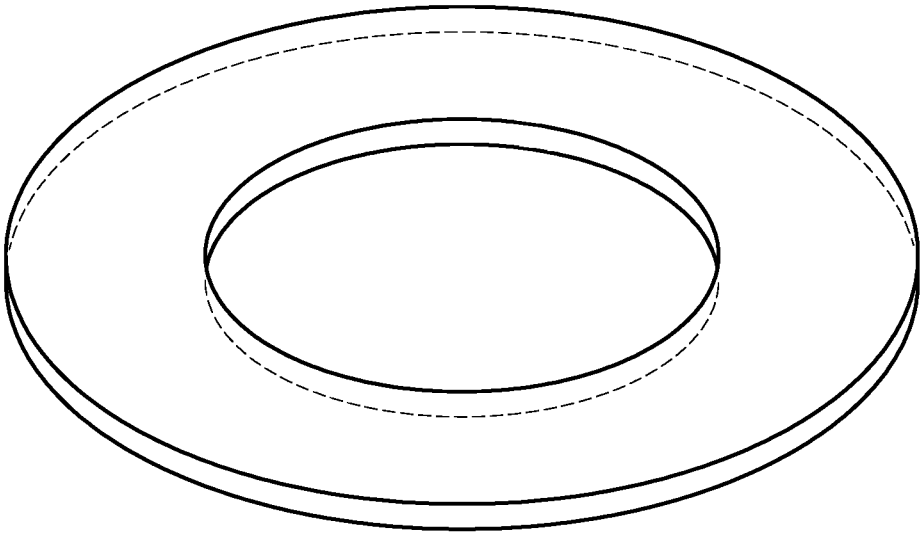
FIG. 20 shows an exemplary light modifier.
Figure 21:
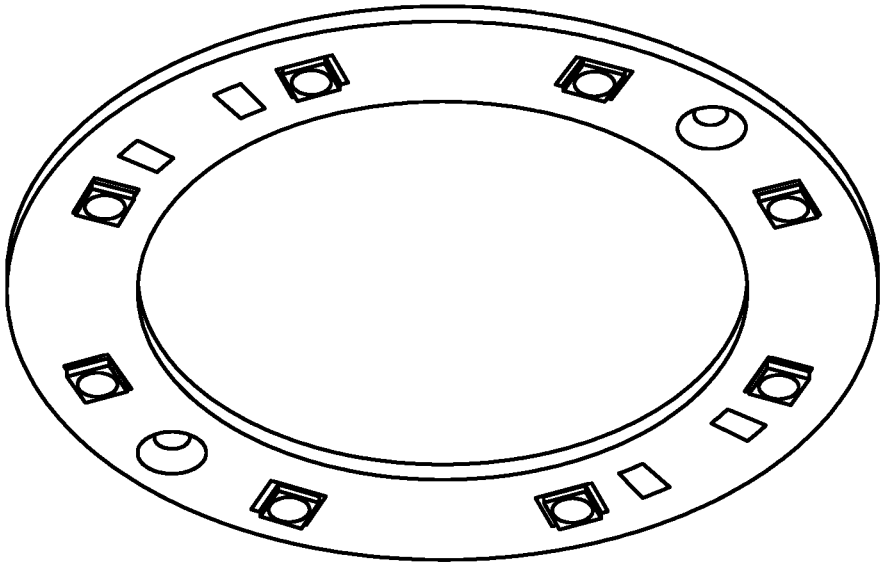
FIG. 21 shows an exemplary printed circuit board having light sources for use with the exemplary light modifier of FIG. 20.

This Detailed Description merely describes exemplary embodiments of the invention and is not intended to limit the scope of the claims in any way. Indeed, the invention as claimed is broader than the exemplary embodiments, and the terms used in the claims have their full ordinary meaning, unless an express definition is provided herein.

As taught herein, a unitary gasket-reflector is provided for use in a light source having at least one reflector and at least one gasket to seal the inside of the light source against the elements (e.g., prevent unpressurized flowing water from flowing in or being drawn in by capillary action). In exemplary embodiments, the unitary gasket-reflector comprises an internal volume defined by one or more internal surfaces of the unitary gasket-reflector, the internal surfaces of the unitary gasket-reflector that define the internal volume having a reflectance of at least 93% or at least 94% or at least 95% (depending on the reflector characteristics, e.g., wall thickness); and at least one channel defined in the unitary gasket-reflector for accepting a light modifier and sealing the light modifier with respect to the internal volume.

Referring now to FIGS. 1, 1A, 1B-5 and 13-18, an exemplary unitary gasket-reflector 10 is shown. The unitary gasket-reflector 10 comprises an internal volume 12 defined by one or more internal surfaces 11 of the unitary gasket-reflector 10, the internal surfaces 11 of the unitary gasket-reflector 10 that define the internal volume 12 having a reflectance of at least 93% or at least 94% or at least 95% or at least 96% or at least 97% (e.g., reflectance with respect to frequencies of electromagnetic radiation transmitted by light sources to be acted upon by the light modifier 16 and/or transmitted by the light module; the reflectance value depending on the reflector characteristics, e.g., wall thickness); and at least one channel 14 defined in the unitary gasket-reflector 10 for accepting a light modifier 16 and sealing the light modifier 16 with respect to the internal volume 12.

In exemplary embodiments, some or all of the unitary gasket-reflector 10 is made of a material flexible enough to be compressed by a force outside the unitary gasket-reflector 10 to form the seal. In exemplary embodiments, the entire unitary gasket-reflector 10 is molded from a single composition that provides both the reflectance in the reflector portion and the flexibility in the channel portion. In exemplary embodiments, the entire unitary gasket-reflector 10 is molded from Dow Corning brand MS-2002 material.

In exemplary embodiments, the unitary gasket-reflector 10 has a projection 18 in a wall opposite the channel 14, which projection 18 is compressed against the light modifier 16 to seal the light modifier 16. In the exemplary embodiment shown in the figures, the portion 20 of the unitary gasket-reflector 10 with the channel 14 has a projection 18 in a wall opposite the channel 14, wherein the projection 18 is sufficiently long and the channel 14 extends deep enough into the projection 18 that when the projection 18 is sandwiched between opposing forces applied generally perpendicular to a depth axis 22 of the channel 14 (e.g., a longitudinal axis of the light modifier), the unitary gasket-reflector 10 is compressed against the light modifier 16 to seal the light modifier 16 with respect to the internal volume 12. In exemplary embodiments, the projection 18 and the channel 14 are formed by at least first and second walls of the unitary gasket-reflector 10, which walls contact respective opposite sides of the light modifier 16, e.g., the first and second walls are connected to each other proximate an edge of the light modifier 16 and form a V shape or a U shape. In the exemplary embodiment shown in the figures, the projection 18 and the channel 14 are formed by at least a first wall 30, a second wall 32, and a third wall 34 (FIGS. 1A and 1B) of the unitary gasket-reflector 10, which first and second walls 30, 32 are spaced from each other and contact respective opposite sides of the light modifier 16, and which third wall 34 connects the first and second walls 30, 32 and also provides a terminating surface 35 of the channel 14 that contacts an edge of the light modifier 16. In exemplary embodiments, the channel is configured as a continuous channel forming a closed shape, e.g., a circle, an oval, or some other cornered or rounded shape such as a rounded rectangle.

In exemplary embodiments, the unitary gasket-reflector 10 comprises the channel 14 and a second channel 14*a* (with corresponding second projection 18*a*) spaced from and opposite said channel 14 to accept and hold a light modifier 16 having an opening therein and having at least one outer edge and at least one inner edge, with said channel 14 accepting and holding the at least one outer edge and the second channel 14*a* accepting and holding the at least one inner edge. In exemplary embodiments, the second projection 18*a* and the second channel 14*a* are formed by at least first and second walls of the unitary gasket-reflector 10, which walls contact respective opposite sides of the light modifier 16, e.g., the first and second walls are connected to each other proximate an edge of the light modifier 16 and form a V shape or a U shape. In the exemplary embodiment shown in the figures, the second projection 18*a* and the second channel 14*a* are formed by at least a first wall 30*a*, a second wall 32*a*, and a third wall 34*a* (FIGS. 1A and 1B) of the unitary gasket-reflector 10, which first and second walls 30*a*, 32*a* are spaced from each other and contact respective opposite sides of the light modifier 16, and which third wall 34*a* connects the first and second walls 30*a*, 32*a* and also provides a terminating surface 35 of the channel 14*a* that contacts an edge of the light modifier 16. In the exemplary embodiment shown in the figures, the two channels 14, 14*a* are configured as continuous channels forming a circle to accept an annular light modifier 16.

In exemplary embodiments, the unitary gasket-reflector 10 has an opening 36 and a distal end 38 opposite the opening 36, the distal end 38 having electromagnetic energy transmitting regions therein to permit the electromagnetic radiation from light sources 40 to enter the volume 12. In exemplary embodiments, the distal end 38 has openings 42 therein to permit the electromagnetic radiation from light sources 40 to enter the volume 12.

In exemplary embodiments, light modifier 16 comprises a member having any one or any two or more of the following characteristics: one or more compositions absorbing the electromagnetic radiation transmitted by the light sources 40 and transmitting light at a different frequency, e.g., a phosphor material that converts 455-460 nm wavelength electromagnetic radiation into light in the range of 2700 Kelvin to 5000 Kelvin; and/or transparent; and/or translucent; and/or light-diffusing; and/or colored. In exemplary embodiments, at least the portion of the light modifier 16 inserted into the channel 14 is substantially planar with a substantially uniform thickness. Exemplary materials include INTEMATIX brand materials, e.g., CL-827-LR-PC for 2700 Kelvin light and CL-830-LR-PC for 3000 Kelvin light. In exemplary embodiments, the light modifier 16 is a substantially planar member with a substantially uniform thickness. In exemplary embodiments, the light modifier 16 is a substantially planar member with a substantially uniform thickness having an opening formed therein. In the exemplary embodiment shown in the figures, the light modifier 16 is a substantially planar annular member with a substantially uniform thickness.

In exemplary embodiments, exemplary light modules comprise a housing having at least one opening, a light modifier (any of the exemplary light modifiers described herein and/or shown herein), at least one light source emitting electromagnetic radiation, and at least one unitary gasket-reflector 10 (any of the exemplary unitary gasket-reflectors described herein and/or shown herein), e.g., a unitary gasket-reflector positioned and configured to reflect electromagnetic radiation emitted by the at least one light source toward the light modifier, the unitary gasket-reflector comprising, an internal volume defined by one or more internal surfaces of the unitary gasket-reflector, the internal surfaces of the unitary gasket-reflector that define the internal volume having a reflectance of at least 95% with respect to the electromagnetic radiation emitted by the at least one light source and reflected by the unitary gasket-reflector toward the light modifier, and at least one channel defined in the unitary gasket-reflector for accepting the light modifier and sealing the light modifier with respect to the internal volume.

FIGS. 4-12 show various views of an exemplary light module 50 using any of the unitary gasket-reflectors described and/or shown herein. In exemplary embodiments, exemplary light module 50 comprises a housing 52, a retaining ring 54, a bottom cap 56, a light modifier 16 (any of the exemplary light modifiers described herein and/or shown herein), at least one light source 40 (e.g., a printed circuit board 60 carrying LEDs such as LEDs that emit royal blue 455-460 nm wavelength light) emitting electromagnetic radiation, and at least one unitary gasket-reflector 10 (any of the exemplary unitary gasket-reflectors described herein and/or shown herein). The reflector made of Dow Corning MS-2002 reflects about 97 percent of light in the 455-460 nm wavelength range. The last figure of the Appendix shows a cross sectional view of an exemplary light module having an exemplary LED driver circuit board in the space (the donut hole, so to speak) formed by the annulus of the reflector and light changer.

In the exemplary embodiment shown in the figures, the housing 52 of exemplary light module 50 comprises a cavity into which the printed circuit board 60 and the unitary gasket-reflector 10 are inserted. Threaded fasteners (not shown) screwed into screw bosses 70 secure the PCB 60 to the housing 52. The openings 42 in the unitary gasket-reflector 10 are aligned with the LEDs 40. An annular light modifier 16 (any of the exemplary light modifiers described herein and/or shown herein) is inserted into the channels 16, 16*a* prior to securing the unitary gasket-reflector 10 to the housing 52 with the retaining ring 54 and the bottom cap 56. The retaining ring 54 secures outer projection 18 and the outer edge of the annular light modifier 16 and the bottom cap 56 secures inner projection 18*a* and the inner edge of the annular light modifier 16. As shown, threaded fasteners secure retaining ring 54 and bottom cap 56 to the housing 52 via screw bosses.

Figure 22:
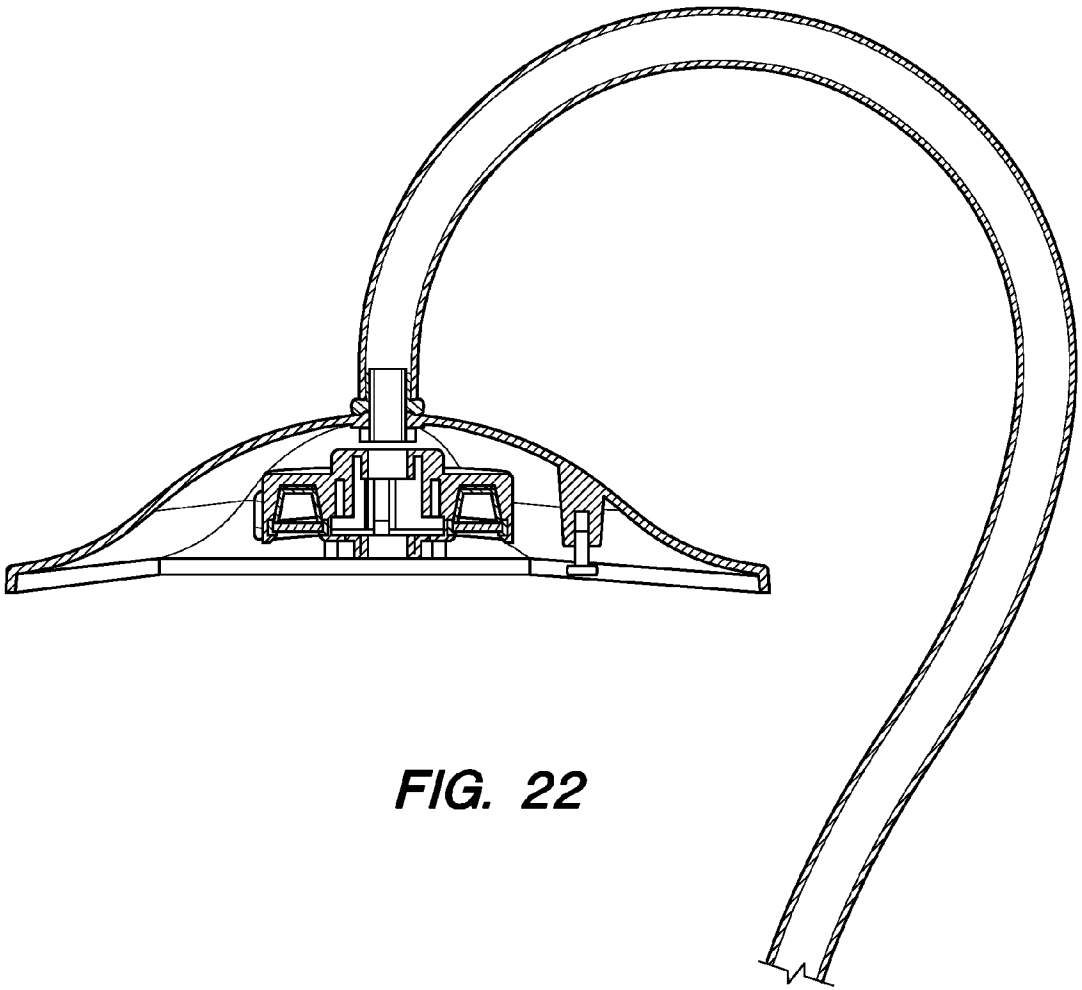
FIGS. 22 and 23 show exemplary light fixtures using at least one unitary gasket-reflector described herein.
Figure 23:
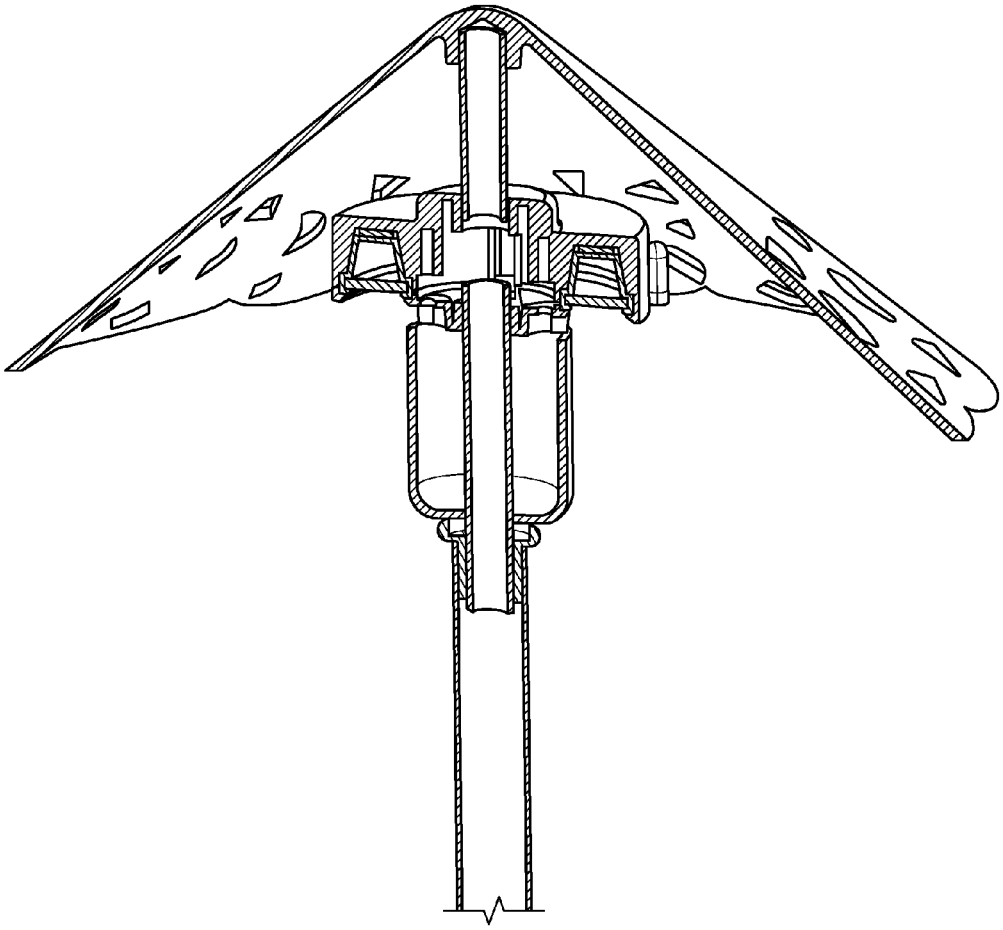

FIGS. 22 and 23 show exemplary light fixtures using at least one lighting module of FIGS. 4-12 using at least one of the unitary gasket-reflector described herein. Wiring (not shown) to power the LEDs via a driver (also not shown) on the PCB are carried through the conduit of the fixture. The light fixture is oriented with the light coming down from the light module. In contrast, many typical fixtures have the light shining upwards into the bottom of the shade, which reflects the light downward. In the fixtures of FIGS. 22 and 23, having the light module shine the light directly down provides the following benefits: provides direct lighting, which allows for a brighter light to be transmitted for less power (no losses because of reflection off of the shade as with typical light sources); increased light uniformity, light output independent of the configuration of the underside of the fixture, and reduced glare.

Figure 24A:
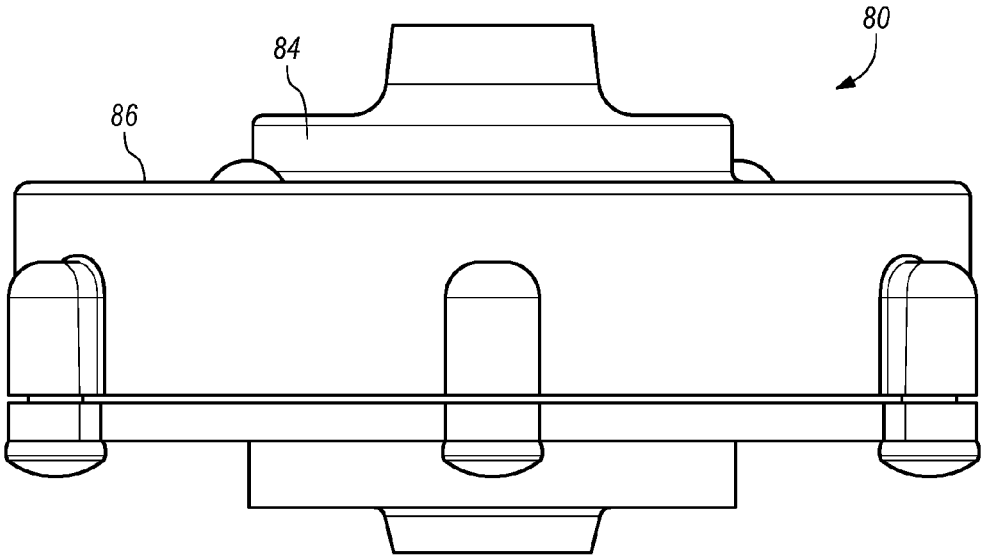
FIGS. 24A-24C show an alternate embodiment of an exemplary light module including the exemplary unitary gasket-reflector of FIGS. 1-3.
Figure 24B:
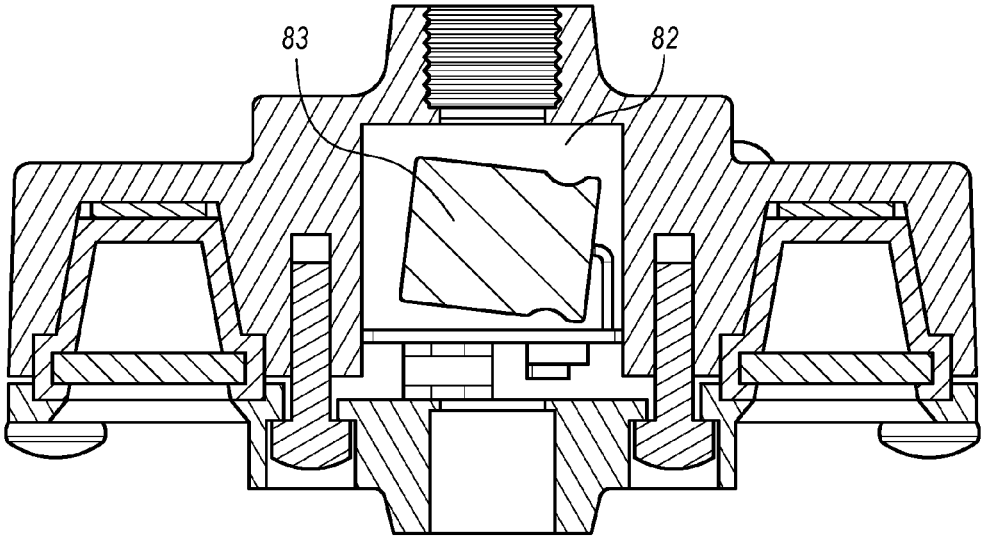
Figure 24C:
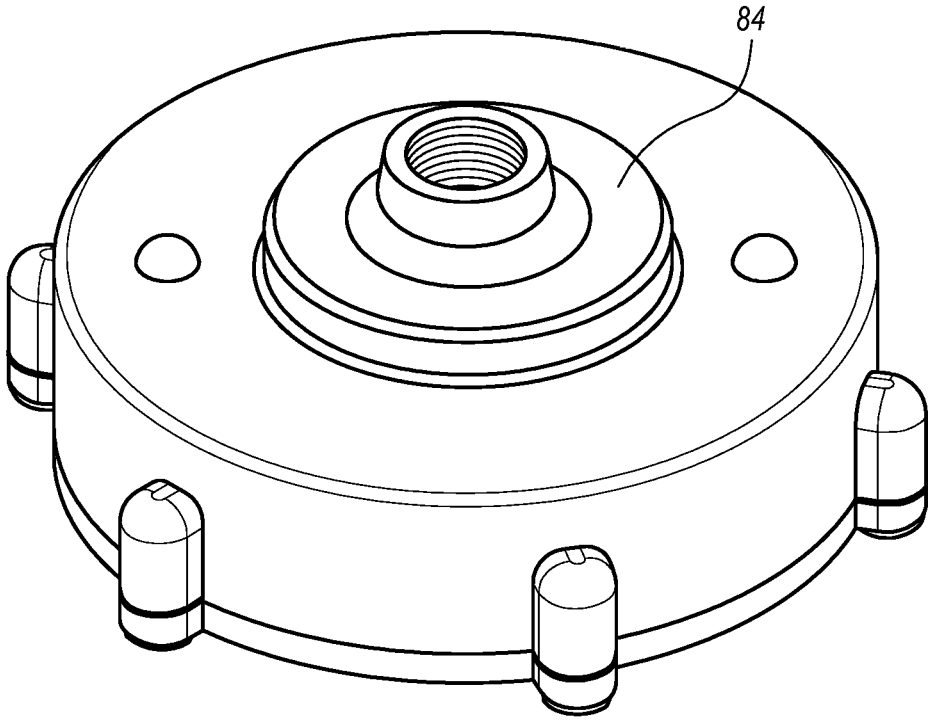

FIGS. 24A-24C show an additional embodiment of another exemplary light module 80 that is the same as module 50 (including the exemplary unitary gasket-reflector of FIGS. 1-3) except that it provides additional room 82 for the LED driver circuitry 83. More specifically, in FIGS. 24A-24C, a cylindrical portion 84 extends up from a surface 86 of the module 80 to provide room 82 for the LED circuitry 83.

In an alternate embodiment, the LEDs 40 provide light in a desired range, e.g., 2700K LEDs or 3000K LEDs or 4000K LEDs or 5000K LEDs (or other LEDs emitting light in the range of 2500K to 5000K), and the light modifier 16 is simply an annular diffuser or a transparent annulus or some other annular piece that does not transform the frequency (color) of light from the LEDs 40 into a different color or color range.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, the steps of all processes and methods herein can be performed in any order, unless two or more steps are expressly stated as being performed in a particular order, or certain steps inherently require a particular order. Accordingly, departures may be made from such details without departing from the spirit or scope of the applicant's general inventive concept.

What is claimed is:

1. A light module, comprising:

a housing having at least one opening;

a substantially planar light modifier having substantially uniform thickness comprising an opening therein and having at least an outer edge;

at least one light source emitting electromagnetic radiation; and a unitary gasket-reflector molded from a single composition, positioned and configured to reflect electromagnetic radiation emitted by the at least one light source toward the light modifier, the unitary gasket-reflector comprising:

an internal volume defined by one or more internal surfaces of the unitary gasket-reflector, the internal surfaces of the unitary gasket-reflector that define the internal volume having a reflectance of at least 95% with respect to the electromagnetic radiation emitted by the at least one light source and reflected by the unitary gasket-reflector toward the light modifier;

a channel formed by at least a first and a second wall of the unitary gasket-reflector for accepting the outer edge of the light modifier where the first and second walls contact respective opposite sides of the light modifier to seal the light modifier with respect to the internal volume, the first and second walls being connected to each other proximate the outer edge of the light modifier; and a distal end opposite the light modifier, the distal end having openings or other electromagnetic energy transmitting regions therein to permit the electromagnetic radiation from the at least one light source to enter the internal volume.

2. The light module of claim 1, wherein the light modifier is substantially planar.

3. The light module of claim 2, wherein the unitary gasket reflector comprises a third wall projecting from the second wall, the third wall being sufficiently long and the first channel extending deep enough that a portion of the first wall, the second wall, and the third wall are sandwiched between opposing forces applied generally perpendicular to a depth axis of the channel.

4. The light module of claim 1, wherein the light modifier has a substantially uniform thickness.

5. The light module of claim 4, wherein the unitary gasket reflector comprises a third wall projecting from the second wall, the third wall being sufficiently long and the first channel extending deep enough that a portion of the first wall, the second wall, and the third wall are sandwiched between opposing forces applied generally perpendicular to a depth axis of the channel.

6. The light module of claim 1, wherein the unitary gasket reflector is molded from a single composition.

7. The light module of claim 6, wherein the unitary gasket reflector comprises a third wall projecting from the second wall, the third wall being sufficiently long and the first channel extending deep enough that a portion of the first wall, the second wall, and the third wall are sandwiched between opposing forces applied generally perpendicular to a depth axis of the channel.

8. The light module of claim 1, wherein the unitary gasket reflector is molded from a composition having a reflectance of at least 95% with respect to the electromagnet radiation emitted by the at least one light source.

9. The light module of claim 8, wherein the composition is flexible enough to be compressed by a force outside the unitary gasket-reflector to form a seal between the unitary gasket reflector and the light modifier.

10. The light module of claim 9, wherein the unitary gasket reflector comprises a third wall projecting from the second wall and molded from the composition, the third wall being sufficiently long and the first channel extending deep enough that a portion of the first wall, the second wall, and the third wall are sandwiched between opposing forces applied generally perpendicular to a depth axis of the channel.

11. The light module of claim 8, wherein the unitary gasket reflector comprises a third wall projecting from the second wall and molded from the composition, the third wall being sufficiently long and the first channel extending deep enough that a portion of the first wall, the second wall, and the third wall are sandwiched between opposing forces applied generally perpendicular to a depth axis of the channel.

12. The light module of claim 1, wherein the portion of the unitary gasket-reflector which comprises the channel is formed from a composition flexible enough to be compressed by a force outside the unitary gasket-reflector to form a seal between the unitary gasket reflector and the light modifier.

* * * * *